US007437846B2

(12) United States Patent
Franco et al.

(10) Patent No.: US 7,437,846 B2
(45) Date of Patent: Oct. 21, 2008

(54) DUAL WINDOW DISPLAY BOX

(76) Inventors: Natali Franco, 2100 N. Ocean Blvd., #23b, Fort Lauderdale, FL (US) 33305; Stephen G. E. Crane, 1201 NW. 65th Pl., Fort Lauderdale, FL (US) 33309

( * ) Notice: Subject to any disclaimer, the term of this patent is extended or adjusted under 35 U.S.C. 154(b) by 0 days.

(21) Appl. No.: 11/711,254

(22) Filed: Feb. 26, 2007

(65) Prior Publication Data

US 2008/0204474 A1 Aug. 28, 2008

(51) Int. Cl.
*A47G 1/06* (2006.01)

(52) U.S. Cl. ..... 40/729; 40/711; 40/730; 40/734; 40/743; 206/523; 206/449

(58) Field of Classification Search ..... 40/711, 40/729, 730, 734, 743, 800; 206/523, 449, 206/371, 818

See application file for complete search history.

(56) References Cited

U.S. PATENT DOCUMENTS 2,288,732 A * 7/1942 Nickerson ..... 40/734
2,416,976 A * 3/1947 Barbieri ..... 40/734
3,456,374 A * 7/1969 Baermann ..... 40/701
5,230,172 A * 7/1993 Hsu ..... 40/732
5,502,907 A * 4/1996 Wang ..... 40/711
5,544,438 A * 8/1996 Fazekas ..... 40/605
6,256,914 B1 * 7/2001 Yeh ..... 40/720
7,146,759 B2 * 12/2006 Bell ..... 40/734

* cited by examiner

*Primary Examiner*—Gary C Hoge
(74) *Attorney, Agent, or Firm*—Raymond Y. Chan; David and Raymond Patent Firm

(57) ABSTRACT

A dual window display box for displaying two objects includes a display arrangement and an attachment arrangement. The display arrangement includes at least two displaying frames, wherein each of the displaying frames has a displaying window and defines a storage cavity between the displaying frames when the displaying frames are overlapped with each other for the first and second objects receiving in the storage cavity. The attachment arrangement includes a first attaching member provided on one of the displaying frame and a second attaching member which is provided on another the displaying frame and is detachably attached to the first attaching member to detachably engage the displaying frames in an overlapped manner such that the display arrangement provides dual display effect on the opposed displaying windows of the displaying frames for individually displaying the first and second objects at two opposite directions.

13 Claims, 6 Drawing Sheets

DUAL WINDOW DISPLAY BOX

BACKGROUND OF THE PRESENT INVENTION

1. Field of Invention

The present invention relates to a display device, and more particularly to a dual window display box which is capable of displaying two objects in two opposite directions respectively.

2. Description of Related Arts

A conventional display box, such as a photo frame, usually comprises a main frame having a displaying cavity formed therein, a displaying window formed on a front side of the main frame, and a transparent cover attached on the displaying window for physically separating the displaying cavity with an exterior of the display box so as to protect the object within the displaying cavity. Very often, the conventional display box further comprises some sorts of supporting devices and locking devices for allowing the display box to stand on a flat surface, and for selectively locking up the displaying cavity respectively.

There exist several disadvantages in relation to this conventional display box. First, almost all conventional display boxes can only display a predetermined object, such as a photo, in a single direction, for there is only usually one single display window on the main frame. Thus, a user of the conventional display box must buy different display boxes for displaying different objects, such as different photos, at the same time.

Second, almost all conventional display boxes only serve one particular purpose. For example, conventional photo frames are usually designed for displaying photos only. They are not usually designed to display other objects. Similarly, conventional diploma display frames are usually designed to display one single diploma only and there is little possibility, if any, for the users to utilize them to display other objects, or to display more than one diploma at the same time.

Finally, there exists problem of retention of the object within the display box. Very often, the displaying cavity of the display box is shaped and sized to fit a predetermined object. This means that most display boxes are designed to display only thin sheets of paper, such as photos. They are incapable of displaying objects other than papers because they are difficult to be retained within the displaying cavity.

SUMMARY OF THE PRESENT INVENTION

A main object of the present invention is to provide a dual window display box which is capable of displaying two objects in two opposed directions respectively at the same time.

Another object of the present invention is to provide a dual window display box comprising a display arrangement which is capable of displaying a wide variety of objects in two opposed directions at the same time, wherein the display arrangement is capable of securely retaining the objects within the storage cavity irrespective the shape of the objects.

Another object of the present invention is to provide a dual window display box comprising an attachment arrangement which is capable of easily and effectively attaching two displaying frames for displaying two objects in two opposed directions at the same time.

Another object of the present invention is to provide a dual window display box which does not involve complicated mechanical structures or components so as to minimize the manufacturing cost of the present invention.

Accordingly, in order to accomplish the above objects, the present invention provides a dual window display box for displaying two objects, comprising:

a display arrangement comprising at least two displaying frames, wherein each of the displaying frames has a displaying window and define a storage cavity between the displaying frames when the displaying frames are overlapped with each other for the first and second objects receiving in the storage cavity; and an attachment arrangement comprising a first attaching member provided on one of the displaying frame and a second attaching member which is provided on another the displaying frame and is detachably attached to the first attaching member to detachably engage the displaying frames in an overlapped manner such that the display arrangement provides dual display effect on the opposed displaying windows of the displaying frames for individually displaying the first and second objects at two opposite directions.

These and other objectives, features, and advantages of the present invention will become apparent from the following detailed description, the accompanying drawings, and the appended claims.

DETAILED DESCRIPTION OF THE PREFERRED EMBODIMENT

Figure 1:
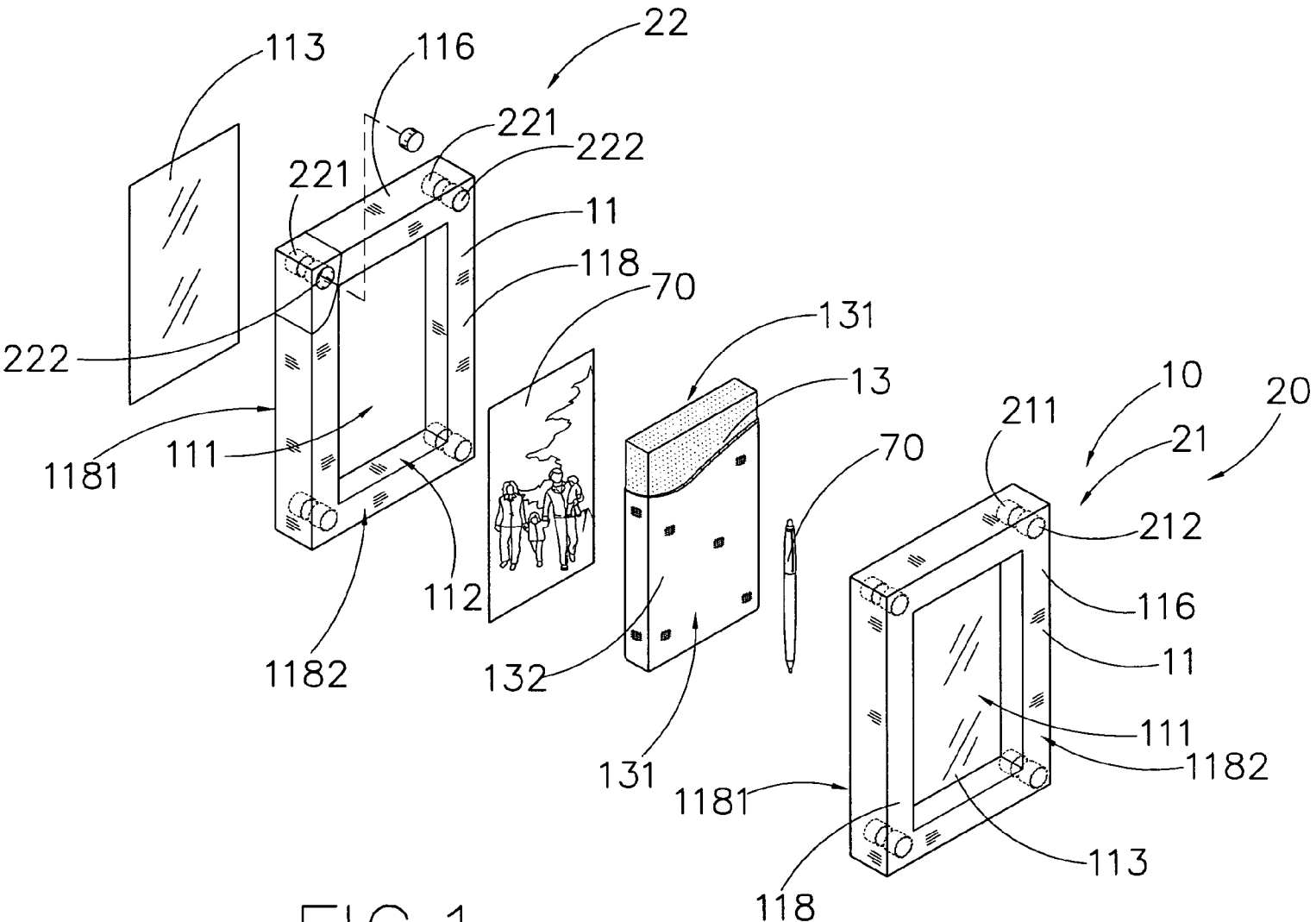
FIG. 1 is an exploded perspective view of the dual window display box according to the above preferred embodiment of the present invention.

Referring to FIG. 1, FIG. 2A to FIG. 2C, FIG. 3A and FIG. 3B of the drawings, a dual window display box for displaying two objects 70, such as two photos, or a photo and a necklace, according to a preferred embodiment of the present invention is illustrated, in which the dual window display box comprises a display arrangement 10 and an attachment arrangement 20.

The display arrangement 10 comprises at least two displaying frames 11 wherein each of the displaying frames 11 has a displaying window 111 and define a storage cavity 112 between the displaying frames 11 when the displaying frames 11 are overlapped with each other for the first and second objects 70 receiving in the storage cavity 112.

The attachment arrangement 20 comprises a first attaching member 21 provided on one of the displaying frame 11 and a second attaching member 22 which is provided on another the displaying frame 11 and is detachably attached to the first attaching member 21 to detachably engage the displaying frames 11 in an overlapped manner such that the display arrangement 10 provides dual display effect on the opposed displaying windows 111 of the displaying frames 11 for individually displaying the first and second objects 70 at two opposite directions. Accordingly, the displaying frames 11 are adapted to self-stand on a surface at a position that the displaying windows 111 of the displaying frames 11 are respectively facing frontward and rearward.

According to the preferred embodiment of the present invention, each of the displaying frames 11 comprises a boundary rim 118 defining the displaying window 111 therewithin, and a transparent window shield 113 mounted to the boundary rim 118 within the displaying window 111 such that when the boundary rims 118 are overlappedly engaged with each other, the displaying windows 111 are aligned with each other to form the storage cavity 112 between the transparent window shields 113 for displaying the first and second objects 70 through the transparent window shields 113.

Each of the displaying windows 111 is a rectangular through opening formed on the respective displaying frame 11 to communicate with the respective storage cavity 112, wherein the respective object 70 is displayed to an observer through the displaying windows 111. It is worth mentioning that in order to protect the objects 70 being displayed, each of the transparent window shields 113 is attached on the corresponding displaying frame 11 for physically shielding the displaying window 111 from an exterior of the dual window display box, and at the same time allowing the respective object 70 to be displayed through the displaying window 111 and the transparent window shield 113.

Figure 2A:
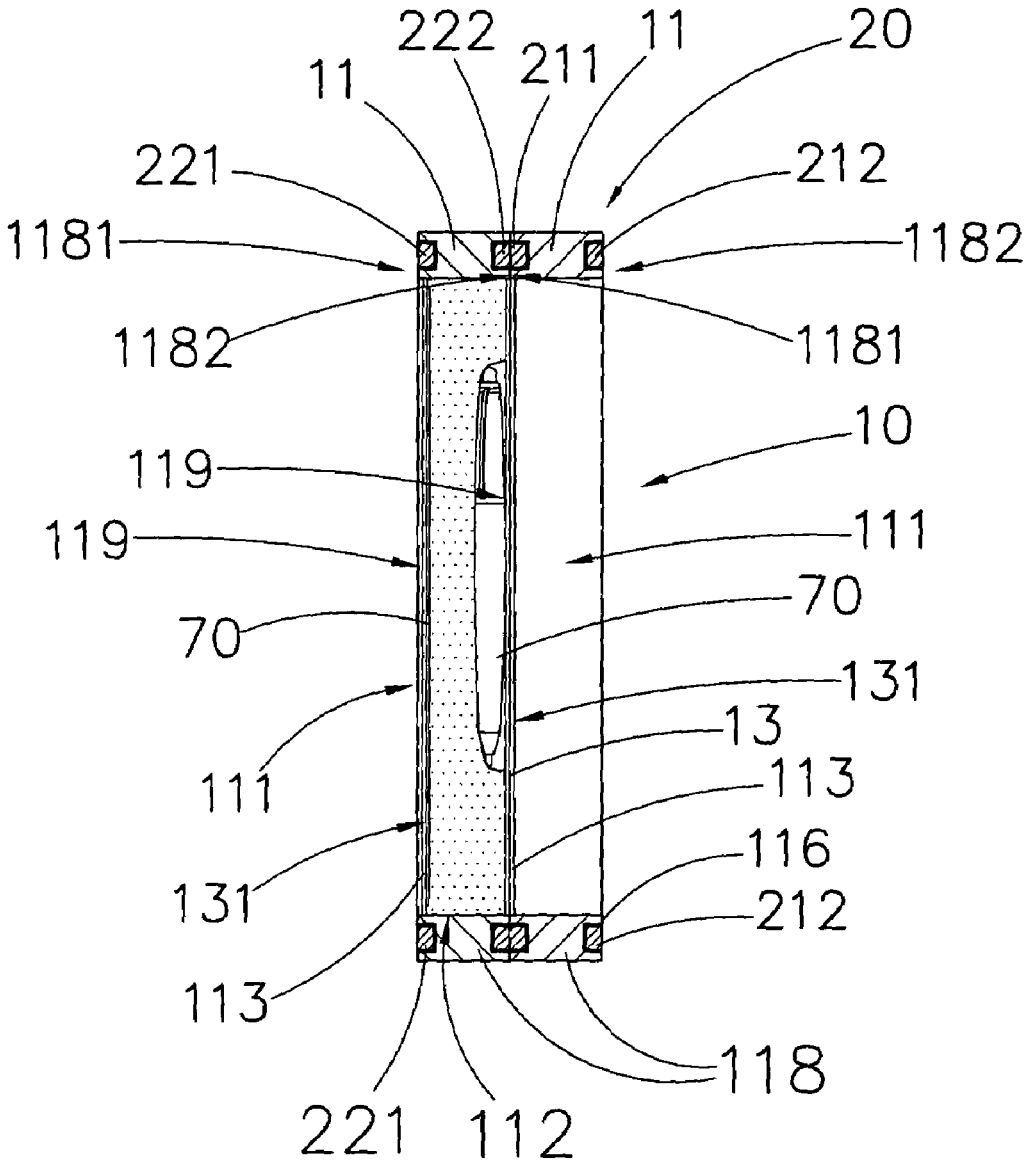
FIG. 2A to FIG. 2C are side views of the dual window display box according to the above preferred embodiment of the present invention, illustrating different attaching configurations of the displaying frames.
Figure 2B:
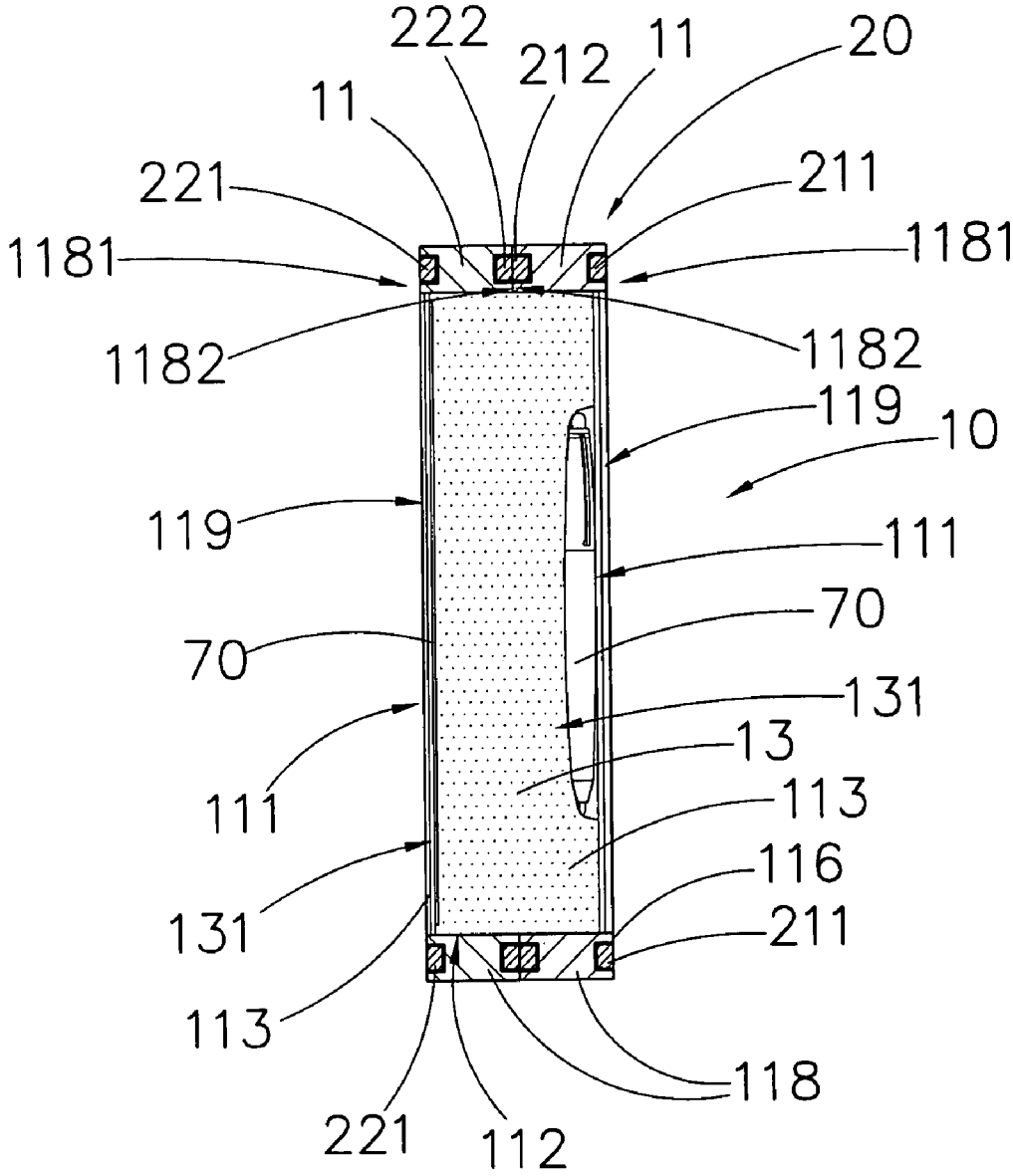

Moreover, each of the boundary rims 118 has a predetermined thickness and has a first side 1181 and an opposed second side 1182 that the transparent window shield 113 is mounted at the first side 1181 of the respective boundary rim 118 such that a size of the storage cavity 112 is selectively adjusted when the second side 1182 of one of the boundary rims 118 is selectively engaged with one of the first and second sides 1181 (1182) of another boundary rim 118, as shown in FIG. 2A and FIG. 2B of the drawings.

In order to retain the objects 70 within the respective display frame 11, the display arrangement 10 further comprises a filling member 13, being made of deformable foaming memory materials to possess a predetermined amount of friction at an outer surface thereof, detachably inserted into the storage cavities 112 of the displaying frames 11 for substantially filling them. Thus, each of the objects 70 is adapted to be inserted into the respective storage cavity 112 and fittedly embedded between an inner surface of the window shield 113 and an outer respective frictional surface of the filling member 13. In other words, the filling member 13 is fittedly deformed by a contour of the corresponding object 70 which is then frictionally and securely retained at a predetermined position within the storage cavity 112. According to the preferred embodiment of the present invention, the filling member 13 is a memory sponge cube, having a predetermined color, shaped and sized to fittedly receive into said storage cavities 112 for retaining the objects 70 to be displayed therewithin. When there is no object engaging with the filling member 13, the filling member 13 restores to its original shape due to its inherent memory and elastic materials characteristics.

In other words, the deformable filling member 13, which is made of foam material, has two deformable sides 131 which are aligned with the displaying windows 111 respectively and are adapted to be self-adjustably deformed for the first and second objects 70 fittingly embedded on the deformable sides 131 respectively for substantially retaining the first and second objects 70 with 3-dimensional structure at the displaying windows 111. Thus, the deformable filling member 13 has a thickness equal to a thickness of each of the displaying frames 11 to fittingly dispose in the storage cavity 112 for holding the first and second objects 70 in a pressurizing manner.

It is worth mentioning that since the filling member 13 is not transparent, it acts as a physical separator for the two displaying frames 11, wherein the objects 70 can be independently displayed via the two displaying windows 111 without visual interference by the other. In other words, one may view one particular object 70 from one particular displaying window 111 without also seeing the other object 70 from that displaying window 111 because the vision is fully blocked by the filling member 13.

Figure 2C:
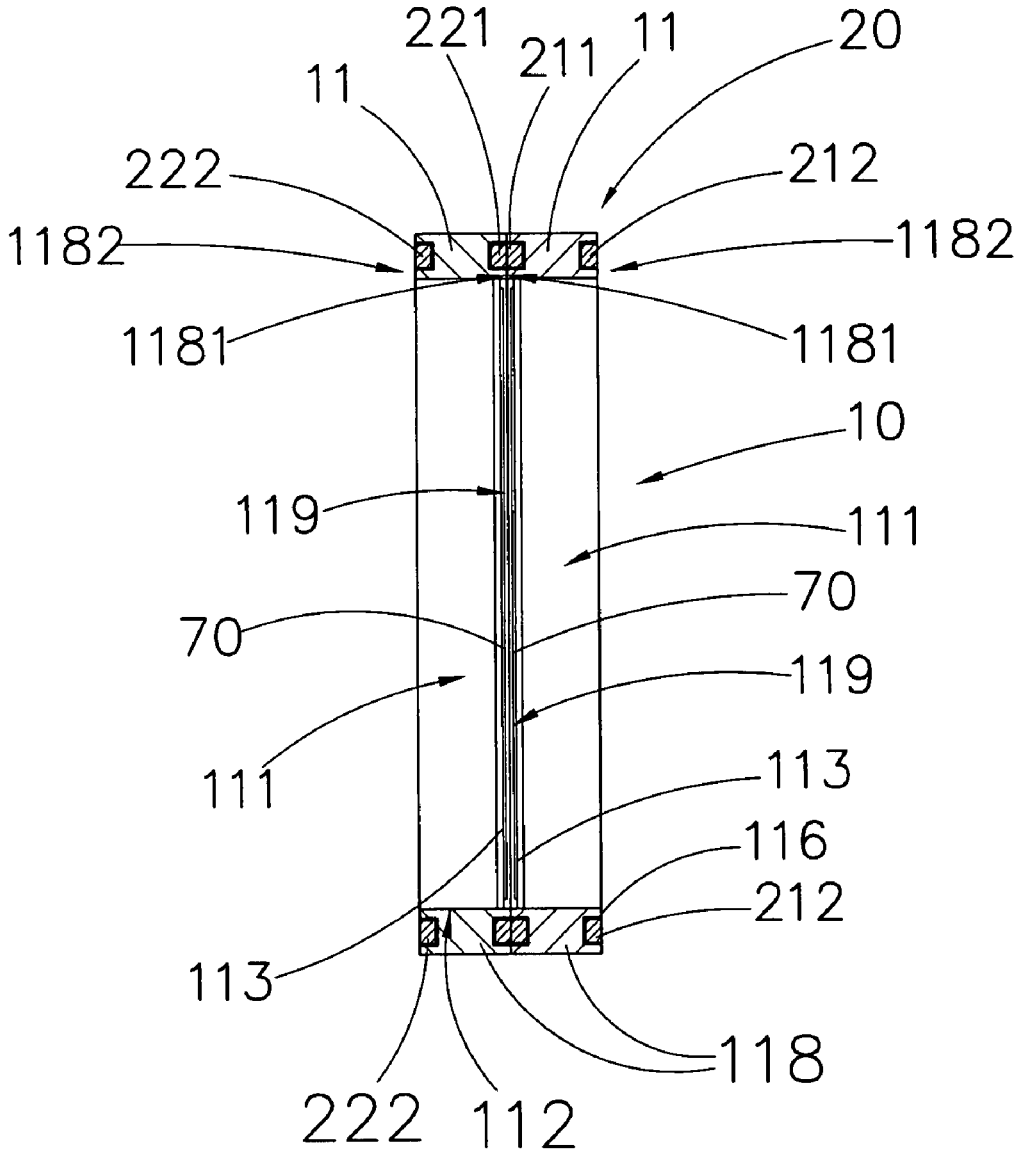
Figure 3A:
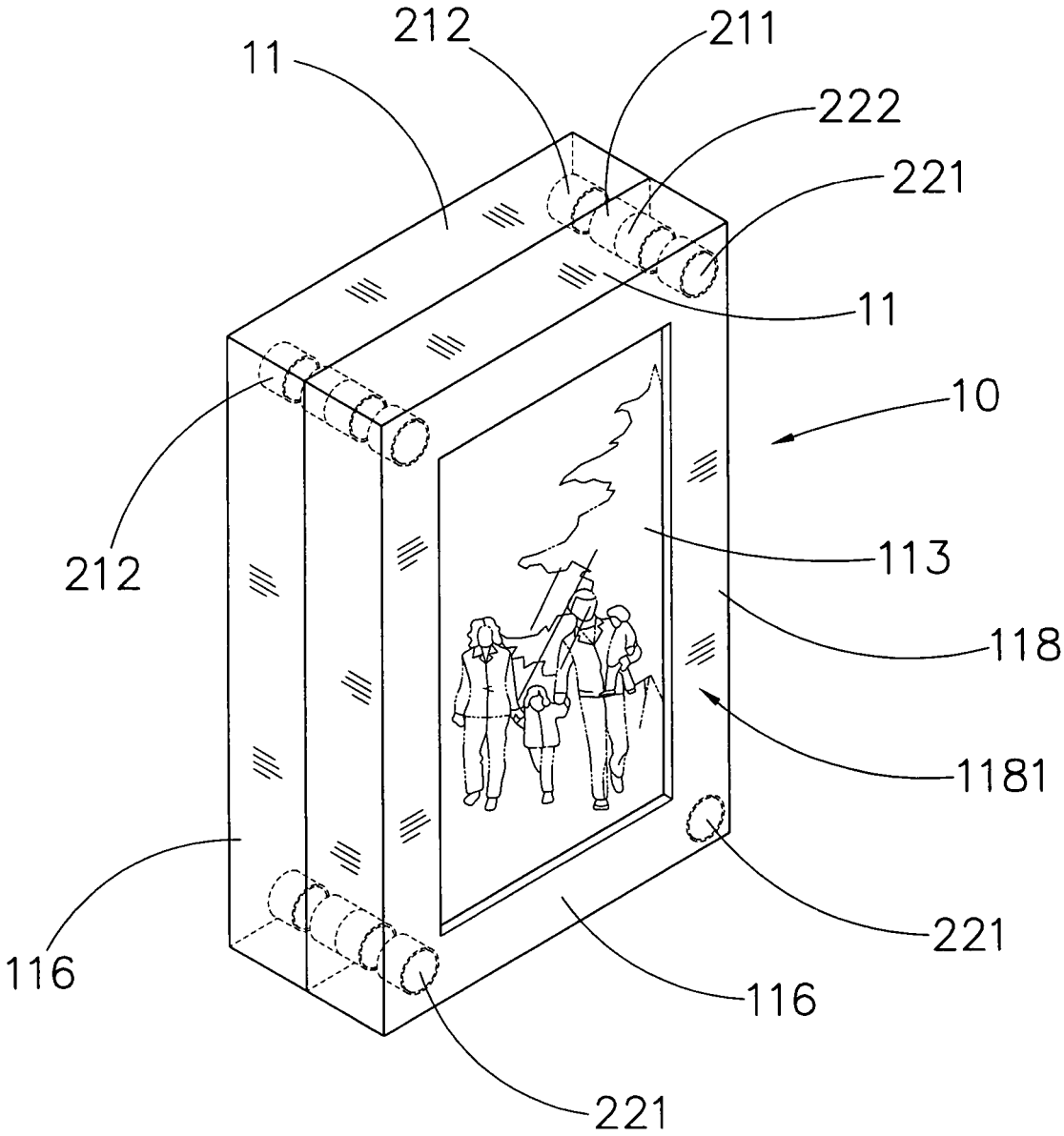
FIG. 3A and FIG. 3B are schematic diagrams of the dual window display box according to the above preferred embodiment of the present invention.
Figure 3B:
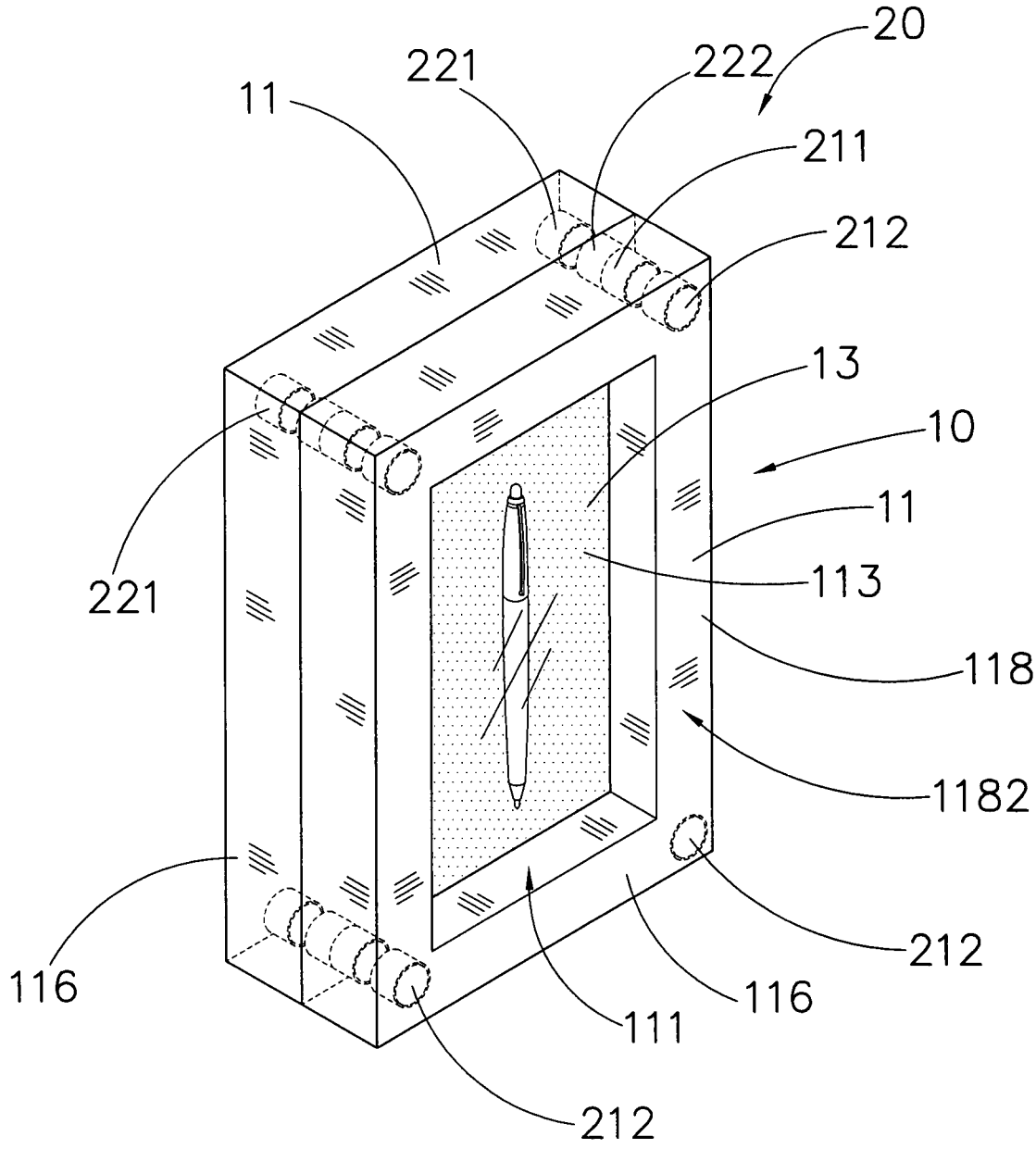

According to the preferred embodiment of the present invention, the first attaching member 21 comprises a first magnetic attachment member 211 attached on the first side 1181 of one of the displaying frames 11 and a first magnet 212 attached on the second side 1182 thereof, wherein the second attaching member 22 comprises a second magnetic attachment member 221 attached on the first side 1181 of another displaying frame 11 and a second magnet 222 attached on the second side 1182 thereof. Accordingly, when the second magnet 222 is magnetically attached to the first magnetic attachment member 211, the second side 1182 of one of the displaying frames 11 is overlappedly coupled with the first side 1181 of another displaying frame 11 as shown in FIG. 2A. When the second magnet 222 is magnetically attached to the first magnet 212, the second sides 1182 of the two displaying frames 11 are overlapped coupled with each other as shown in FIG. 2B. When the second magnetic attachment member 221 is magnetically attached to first magnetic attachment member 211 by means of the magnetic attraction between the first and second magnets 212, 222, the first sides 1181 of the two displaying frames 11 are overlapped coupled with each other as shown in FIG. 2C. Alternatively, the first attaching member 21 can be a magnet and the second attaching member 22 can be a magnetic attachment member in order to achieve the above mentioned attachment configurations as shown in FIGS. 2A to 2C.

Thus, the first magnetic attachment member 211 and the first magnet 212 are embedded on the first and second sides 1181, 1182 of one of the displaying frames 11 respectively, wherein the second magnetic attachment member 221 and the second magnet 222 are embedded on the first and second sides 1181, 1182 of another displaying frame 11 respectively. Therefore, the first and second attaching members 21, 22 are mounted to the displaying frames 11 in a hidden manner. Accordingly, each of the displaying frames 11 contains a plurality of magnetic housings formed on both sides thereof to fittingly receive the corresponding the first magnetic attachment member 211, the first magnet 212, the second magnetic attachment member 221, and the second magnet 222 respectively.

Thus, each of the displaying frames 11 further comprises an outer covering 116, having a specifically designed aesthetic appeal, peripherally attached on an outer surface of the displaying frame 11 so as to enhance an aesthetic appeal of the displaying frame 11, wherein the first and the second attaching member 21, 22 are covered and hidden by the outer covering 116 with a predetermined color for enhancing an overall aesthetic appeal of the entire dual window display box of the present invention.

Moreover, the displaying frames 11 are identical in size and shape such that when the displaying frames 11 are overlappedly engaged with each other, the displaying frames 11 forms an one piece structure to enhance an overall aesthetic appeal of the dual window display box for displaying the first and second objects 70 at two opposite directions.

In order to further enhance the circumstances in which the present invention could be optimally utilized, the display arrangement 10 further comprises an elastic protective cover 132 embedding the deformable filling member 13 therewithin, wherein the protective cover 132 has a predetermined aesthetic pattern formed such that when the object 70 is displayed within the dual window display box, the aesthetic pattern matches optimally with the aesthetic appearance of the object 70 so as produce an enhanced displaying effect of the present invention. Moreover, the protective cover 132 is also arranged to separate the deformable filling member 13 from the object 70 being displayed so as to allow maximum protection for both the object 70 and the deformable filling member 13.

The operation of the dual window display box is as follows: a user of the present invention may put two objects 70, such as a photo and a necklace, into the displaying frames 11 respectively, wherein the two objects 70 are separated by the filling member 13 which is fittedly deformed to embed the objects 70 between the respective window shield 113 and the outer side of the filling member 13. The two displaying frames 11 are then detachably attached with each other for displaying both of the objects 70 simultaneously through the displaying windows 111 respectively. Optionally, the dual window display box may be detachably attached onto a metallic surface. In order to replace the objects 70 within the displaying frames 11, the user only needs to detach each displaying frame 11 from each other and then take out the filling member 13 from the storage cavities 112. Then, the user is able to replace the objects 70.

Referring to FIG. 2C of the drawings, the dual window display box of the present invention may be utilized for displaying two photos without using the deformable filling member 13. In such a case, the transparent window shield 113 of each of the displaying frames 11 is attached on that corresponding displaying frame 11 in such a manner that it is slightly indent from the corresponding boundary rim 118 to form a retention cavity 119 between the inner side edge of the boundary rim 118 and the transparent window shield 113, wherein an object 70, preferably a photo, is disposed within the retention cavity 119. Thus, when the displaying frames 11 are magnetically attached with each other at the first sides 1181, the photos are displayed via two transparent window shields 113 at two opposite directions respectively.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A dual window display box for displaying two objects, comprising:

a display arrangement comprising at least two displaying frames, wherein each of said displaying frames has a displaying window and defines a storage cavity between said displaying frames when said displaying frames are overlapped with each other for said first and second objects receiving in said storage cavity; and an attachment arrangement comprising at least a first attaching member provided on one of said displaying frame and at least a second attaching member which is provided on another said displaying frame and is detachably attached to said first attaching member to detachably engage said displaying frames in an overlapped manner such that said display arrangement provides dual display effect on said opposed displaying windows of said displaying frames for individually displaying said first and second objects at two opposite directions, wherein each of said displaying frames comprises a boundary rim defining said displaying window therewithin and a transparent window shield mounted to said boundary rim within said displaying window such that when said boundary rims are overlappedly engaged with each other, said displaying windows are aligned with each other to form said storage cavity between said transparent window shields for displaying said first and second objects through said transparent window shields, wherein each of said boundary rims has a predetermined thickness and has a first side and an opposed second side that said transparent window shield is mounted at said first side of said respective boundary rim such that a size of said storage cavity is selectively adjusted when said second side of one of said boundary rims is selectively engaged with one of said first and second sides of another said boundary rim.

2. The dual window display box, as recited in claim 1, wherein said display arrangement further comprises a deformable filling member disposed in said storage cavity for holding said first and second objects therewithin.

3. The dual window display box, as recited in claim 1, wherein said first and second attaching members are two corresponding magnetic elements embedded in said displaying frames respectively in a hidden manner to magnetically couple said displaying frames with each other.

4. The dual window display box, as recited in claim 2, wherein said deformable filling member, which is made of foam material, has two deformable sides which are aligned with said displaying windows respectively and are adapted to be self-adjustably deformed for said first and second objects fittingly embedded on said deformable sides respectively for substantially retaining said first and second objects with 3-dimensional structure at said displaying windows.

5. The dual window display box, as recited in claim 2, wherein said deformable filling member has a thickness equal to a thickness of each of said displaying frames to fittingly dispose in said storage cavity for holding said first and second objects in a pressurizing manner.

6. The dual window display box, as recited in claim 2, wherein said first and second attaching members are two corresponding magnetic elements embedded in said displaying frames respectively in a hidden manner to magnetically couple said displaying frames with each other.

7. The dual window display box, as recited in claim 2, wherein said displaying frames are identical in size and shape such that when said displaying frames are overlappedly engaged with each other, said displaying frames forms an one piece structure to enhance an overall aesthetic appeal of said dual window display box for displaying said first and second objects at two opposite directions.

8. The dual window display box, as recited in claim 4, wherein said deformable filling member has a thickness equal to a thickness of each of said displaying frames to fittingly dispose in said storage cavity for holding said first and second objects in a pressurizing manner.

9. The dual window display box, as recited in claim 8, wherein said first and second attaching members are two corresponding magnetic elements embedded in said displaying frames respectively in a hidden manner to magnetically couple said displaying frames with each other.

10. The dual window display box, as recited in claim 8, wherein said displaying frames are identical in size and shape such that when said displaying frames are overlappedly engaged with each other, said displaying frames forms an one piece structure to enhance an overall aesthetic appeal of said dual window display box for displaying said first and second objects at two opposite directions.

11. The dual window display box, as recited in claim 9, wherein said displaying frames are identical in size and shape such that when said displaying frames are overlappedly engaged with each other, said displaying frames forms an one piece structure to enhance an overall aesthetic appeal of said dual window display box for displaying said first and second objects at two opposite directions.

12. A dual window display box for displaying two objects, comprising:

a display arrangement comprising at least two displaying frames, wherein each of said displaying frames has a displaying window and defines a storage cavity between said displaying frames when said displaying frames are overlapped with each other for said first and second objects receiving in said storage cavity; and an attachment arrangement comprising at least a first attaching member provided on one of said displaying frame and at least a second attaching member which is provided on another said displaying frame and is detachably attached to said first attaching member to detachably engage said displaying frames in an overlapped manner such that said display arrangement provides dual display effect on said opposed displaying windows of said displaying frames for individually displaying said first and second objects at two opposite directions, wherein said display arrangement further comprises a deformable filling member disposed in said storage cavity for holding said first and second objects therewithin, wherein said deformable filling member, which is made of foam material, has two deformable sides which are aligned with said displaying windows respectively and are adapted to be self-adjustably deformed for said first and second objects fittingly embedded on said deformable sides respectively for substantially retaining said first and second objects with 3-dimensional structure at said displaying windows.

13. A dual window display box for displaying two objects, comprising:

a display arrangement comprising at least two displaying frames, wherein each of said displaying frames has a displaying window and defines a storage cavity between said displaying frames when said displaying frames are overlapped with each other for said first and second objects receiving in said storage cavity; and an attachment arrangement comprising at least a first attaching member provided on one of said displaying frame and at least a second attaching member which is provided on another said displaying frame and is detachably attached to said first attaching member to detachably engage said displaying frames in an overlapped manner such that said display arrangement provides dual display effect on said opposed displaying windows of said displaying frames for individually displaying said first and second objects at two opposite directions, wherein each of said displaying frames comprises a boundary rim defining said displaying window therewithin and a transparent window shield mounted to said boundary rim within said displaying window such that when said boundary rims are overlappedly engaged with each other, said displaying windows are aligned with each other to form said storage cavity between said transparent window shields for displaying said first and second objects through said transparent window shields, wherein said display arrangement further comprises a deformable filling member disposed in said storage cavity for holding said first and second objects therewithin, wherein said deformable filling member, which is made of foam material, has two deformable sides which are aligned with said displaying windows respectively and are adapted to be self-adjustably deformed for said first and second objects fittingly embedded on said deformable sides respectively for substantially retaining said first and second objects with 3-dimensional structure at said displaying windows.

* * * * *